US006057746A

United States Patent [19]

Ito

[11] Patent Number: 6,057,746

[45] Date of Patent: May 2, 2000

[54] DIELECTRIC DUPLEXER UNIT WITH LC COUPLING CIRCUIT LAMINATE

[75] Inventor: Kenji Ito, Matsuzaka, Japan

[73] Assignee: NGK Spark Plug Co., Ltd., Nagoya, Japan

[21] Appl. No.: 09/073,815

[22] Filed: May 7, 1998

[30] Foreign Application Priority Data

May 7, 1997 [JP] Japan ..... 9-134349

[51] Int. Cl.[7] ..... H01P 1/213

[52] U.S. Cl. ..... 333/134; 333/206

[58] Field of Search ..... 333/126, 129, 333/132, 134, 202, 206

[56] References Cited

U.S. PATENT DOCUMENTS

| | | | |
|---|---|---|---|
| 4,673,902 | 6/1987 | Takeda et al. | 333/206 X |
| 5,686,873 | 11/1997 | Tada et al. | 333/206 X |
| 5,789,998 | 8/1998 | Kim et al. | 333/206 X |

FOREIGN PATENT DOCUMENTS

| | | | |
|---|---|---|---|
| 5-63406 | 3/1993 | Japan | 333/206 |
| 6-125206 | 5/1994 | Japan | 333/202 |
| 7-176913 | 7/1995 | Japan | 333/134 |

*Primary Examiner*—Seungsook Ham
*Attorney, Agent, or Firm*—Larson & Taylor

[57] ABSTRACT

A dielectric duplexer unit which is compact and can be manufactured in a simple way, and includes a dielectric duplexer having a plurality of resonators and a circuit laminate formed by sequentially laying a plurality of dielectric sheets on the open-circuit end surface of the dielectric duplexer, the circuit laminate having coupling circuits which are connected to resonators of an intended resonator circuit of the dielectric duplexer, the assembly of the dielectric duplexer and the circuit laminate being mounted on a substrate and housed in a metal casing to produce a compact unit having a neat profile. As a result a down sized filter circuit is produced to allow the use of a small substrate so that the entire unit is also down sized, and the unit can use a simple wiring arrangement and have an increased mechanical strength and an improved impact resistance.

8 Claims, 7 Drawing Sheets

DIELECTRIC DUPLEXER UNIT WITH LC COUPLING CIRCUIT LAMINATE

BACKGROUND OF THE INVENTION

This invention relates to a dielectric duplexer unit comprising a plurality of resonators arranged in parallel. Such a dielectric duplexer unit can suitably be used for mobile telecommunications equipment such as an automobile telephone set or a portable telephone set.

PRIOR ART

There have been proposed a variety of dielectric duplexer units comprising a dielectric duplexer which includes a dielectric ceramic block, a plurality of resonators arranged in parallel along a same direction in the dielectric ceramic block, each resonator including a through hole bored through the dielectric ceramic block and an inner conductor layer provided on an inner wall of the through hole, and an external conductor layer provided on an outer surface of the dielectric ceramic block except for an open-circuit end surface portion of the block where one of openings of each through hole is exposed, a substrate on which the dielectric duplexer is directly mounted, a coupling circuit means provided on the substrate and coupled to the predetermined resonators and a metal casing for containing the dielectric ceramic block and the coupling circuit means. One example of such dielectric duplexer units is disclosed in Japanese Patent Kokai No. 63-311801.

With any of such dielectric duplexer units, circuit members including coupling capacitors for LC-coupling the resonators are mounted on the substrate and electric paths are provided on the substrate to form a necessary circuit. These elements are covered by the metal casing that operates as a shield case and input/output electrodes are arranged on the substrate for connecting the dielectric duplexer with external electric paths to form a unit, which unit provides an advantage of easy handling.

A dielectric duplexer unit having the above described configuration can enjoy an enhanced level of freedom in terms of designing because coupling capacitors are mounted on the substrate in a separate manufacturing step and hence the circuit constants of the dielectric duplexer can be selected appropriately depending on the specific circuit configuration of the dielectric duplexer.

However, with known dielectric duplexer units of the type under consideration, metal terminals are fitted into the respective resonators of the unit and then connected to the corresponding electric paths formed on the substrate of the unit in order to LC-connect the resonators. Thus, they have drawbacks of requiring complicated connections and a separate operation of mounting the coupling capacitors on the substrate to make the circuit arrangement a rather complicated one, which is provided with untidily disposed wires.

Therefore, an object of the present invention is to provide a dielectric duplexer unit that is free from the above identified problems.

SUMMARY OF THE INVENTION

According to the invention, the above object is achieved by providing a dielectric duplexer unit comprising a dielectric duplexer which includes a plurality of resonators arranged in parallel along a same direction, each resonator including a through hole bored through a dielectric ceramic block and an inner conductor layer provided on an inner wall of the through hole, a substrate on which the dielectric duplexer is directly mounted and a LC coupling circuit means provided on the substrate and coupled to the predetermined resonators, the dielectric duplexer having an open-circuit end surface where one of openings of each through hole is exposed, the resonators being divided into two groups of a transmitter section and a receiver section, characterized in that the LC coupling circuit means comprises a circuit laminate of a plurality of dielectric sheets arranged on the open-circuit end surface of the dielectric duplexer and connected to predetermined ones of the resonators in the transmitter section and/or the receiver section to form a transmission/reception circuit necessary for the dielectric duplexer.

With the above arrangement, the LC coupling circuit has a neat and simple configuration of a laminate of dielectric sheets arranged on the open-circuit end surface of the dielectric duplexer and appropriate values can be selected for the circuit constants of the dielectric duplexer.

Preferably, the dielectric duplexer may comprise a plurality of dielectric ceramic blocks and a coaxial type resonator provided in each of the dielectric ceramic blocks, having a through hole bored through the dielectric block and coated on the inner wall of the through hole with an inner conductor layer. With such an arrangement, the characteristics of each of the coaxial type resonators can be regulated independently to provide a dielectric duplexer having desired characteristics. In this connection, the coaxial type resonators may be assembled in advance or directly and independently secured to the dielectric block.

Alternatively, the dielectric duplexer may comprise a single dielectric ceramic block and a plurality of coaxial type resonators provided in parallel in the dielectric ceramic block, each having a through hole and coated on the inner wall of the through hole with an inner conductor layer. With this arrangement, the coaxial type resonators can be assembled with the substrate in a simple and easy way because the dielectric duplexer is already an integral entity to be assembled.

Preferably, the LC coupling circuit means is in the form of a circuit laminate of a plurality of dielectric sheets arranged on the open-circuit end surface of the dielectric duplexer that is sintered and has a low pass filter circuit section connected to the resonators of the transmitter section and a band pass filter circuit section connected to the resonators of the receiver section to form a transmitter/receiver circuit necessary for the dielectric duplexer.

With this arrangement of forming and sintering a laminate of a plurality of dielectric sheets, the LC coupling circuit means may be realized as a single chip so that a dielectric duplexer unit can be provided simply by bonding the chip to the open-circuit end surface of the dielectric duplexer.

Alternatively, the LC coupling circuit means may comprise a low pass filter circuit section which comprises a circuit laminate of a plurality of dielectric sheets arranged on a region of the transmitter section on the open-circuit end surface of the dielectric duplexer, sintered and connected to the resonators of the transmitter section and a band pass filter circuit section which comprises conductor layers arranged on a region of the receiver section of the open-circuit end surface and connected to the inner conductors of the resonators of the receiver section, the conductor layers being capacitively coupled with each other.

With this arrangement, the circuit laminate can be prepared with ease by forming and sintering patterned conductors on the surfaces of the dielectric sheets to form inductors so that the circuit laminate can be used exclusively for the low pass filter circuit section that is provided with a plurality of inductors and bonded to a transmitter region on the open-circuit end surface of the dielectric duplexer, whereas the band pass filter circuit section having only capacitors can be prepared in a conventional manner by forming conductors films in respective spot facings to form conductor layers or directly forming patterned conductors by printing and connecting them to the inner conductors of the resonators in order to capacitively couple the conductor layers.

DETAILED DESCRIPTION OF THE PREFERRED EMBODIMENTS

Figure 1:
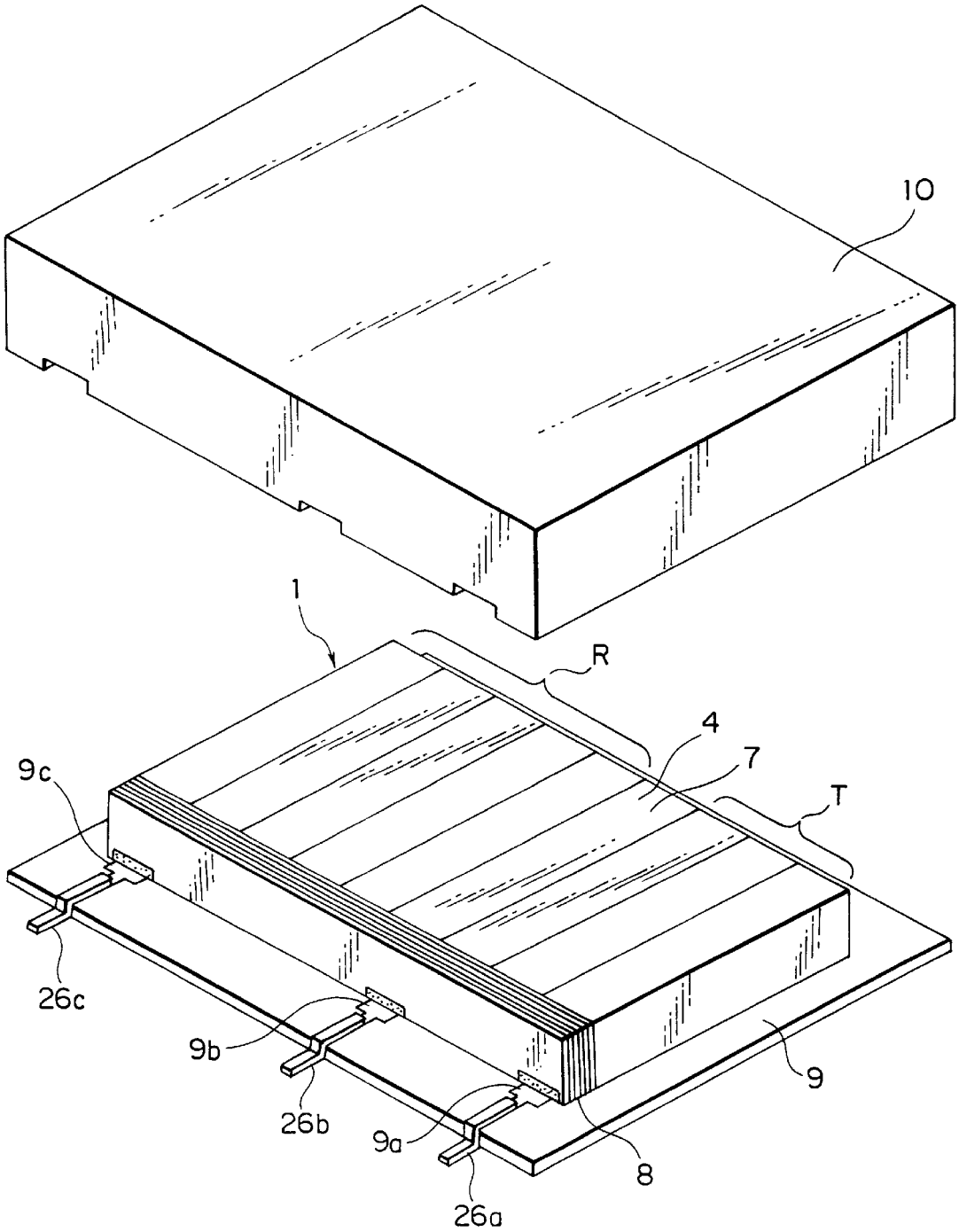
FIG. 1 is an exploded schematic perspective view of an embodiment of a dielectric duplexer unit according to the invention.

Now, the present invention will be described by referring to the accompanying drawings that illustrate preferred embodiments of the invention.

FIG. 1 through 5 schematically illustrate a preferred embodiment of the invention. Reference numeral 1 denotes a dielectric duplexer that comprises a total of nine dielectric ceramic blocks 2, a total of eight coaxial type resonators 3A, 3B, 3C, 3D, 3E, 3F, 3G and 3H provided in the respective dielectric ceramic blocks 2. The respective dielectric ceramic block 2 may be prepared by sintering a block of a dielectric ceramic material typically containing titanium oxide or barium oxide as principal ingredient. The coaxial type resonators 3A–3H are divided into two groups, a group of resonators 3A through 3C and another group of resonators 3D through 3H, the first group operating as 3-pole type transmitter section T, the second group operating as a 5-pole type receiver section R. A spacer resonator 4 is arranged between the transmitter section T and the receiver section R and the resonators are bonded together at the related lateral sides thereof.

Figure 5:
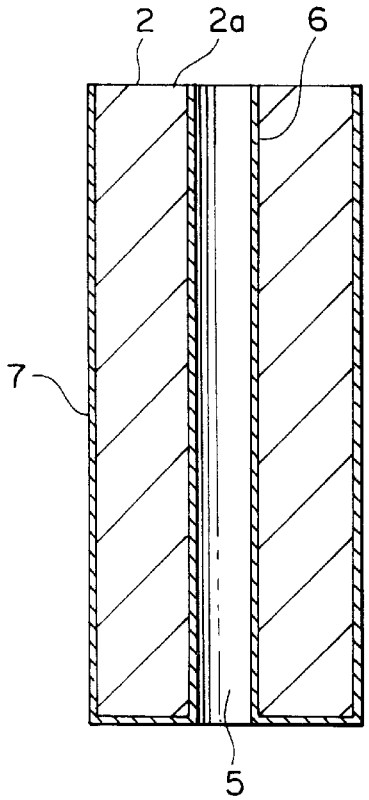
FIG. 5 is a schematic cross sectional lateral view of the coaxial type resonators in the dielectric duplexer unit.

As shown in FIG. 5, each of the resonators comprises a through hole 5 provided through the dielectric ceramic block 2 and an inner conductor layer 6 formed on the inner peripheral surface or inner wall of the through hole 5. The outer surfaces of the dielectric ceramic block 2 are coated with a grounding conductor layer 7 except the open-circuit end surface 2*a* thereof where one of the openings of the through hole 5 is exposed.

The resonators 3A through 3H have a resonant length substantially equal to a quarter of the resonant frequency λ, or λ/4.

Figure 6:
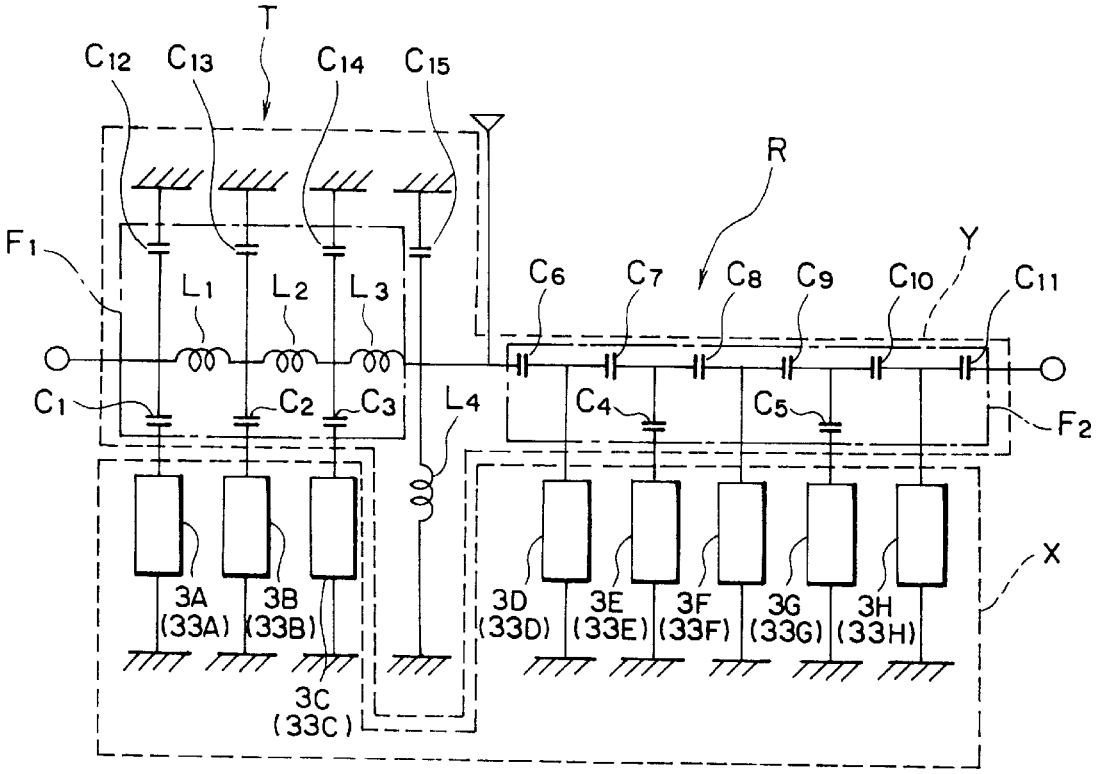
FIG. 6 is a schematic circuit diagram of an equivalent circuit of the embodiments of dielectric duplexer unit according to the invention.

FIG. 6 shows an equivalent circuit X of the dielectric duplexer comprising the resonators 3A through 3H.

Referring to FIGS. 1–4, Reference numeral 8 denotes a circuit laminate which is bonded to the dielectric duplexer 1 to cover the open-circuit end surface of the dielectric duplexer 1 or the open-circuit end surfaces 2*a* of all the dielectric ceramic blocks 2. The dielectric duplexer 1 and the circuit laminate 8 are mounted on a substrate 9 and housed in a metal casing 10, thereby completing a dielectric duplexer unit. It should be noted that the coaxial type resonators 3A through 3H may alternatively be mounted on the substrate 9 side by side without being bonded to each other.

Figure 3:
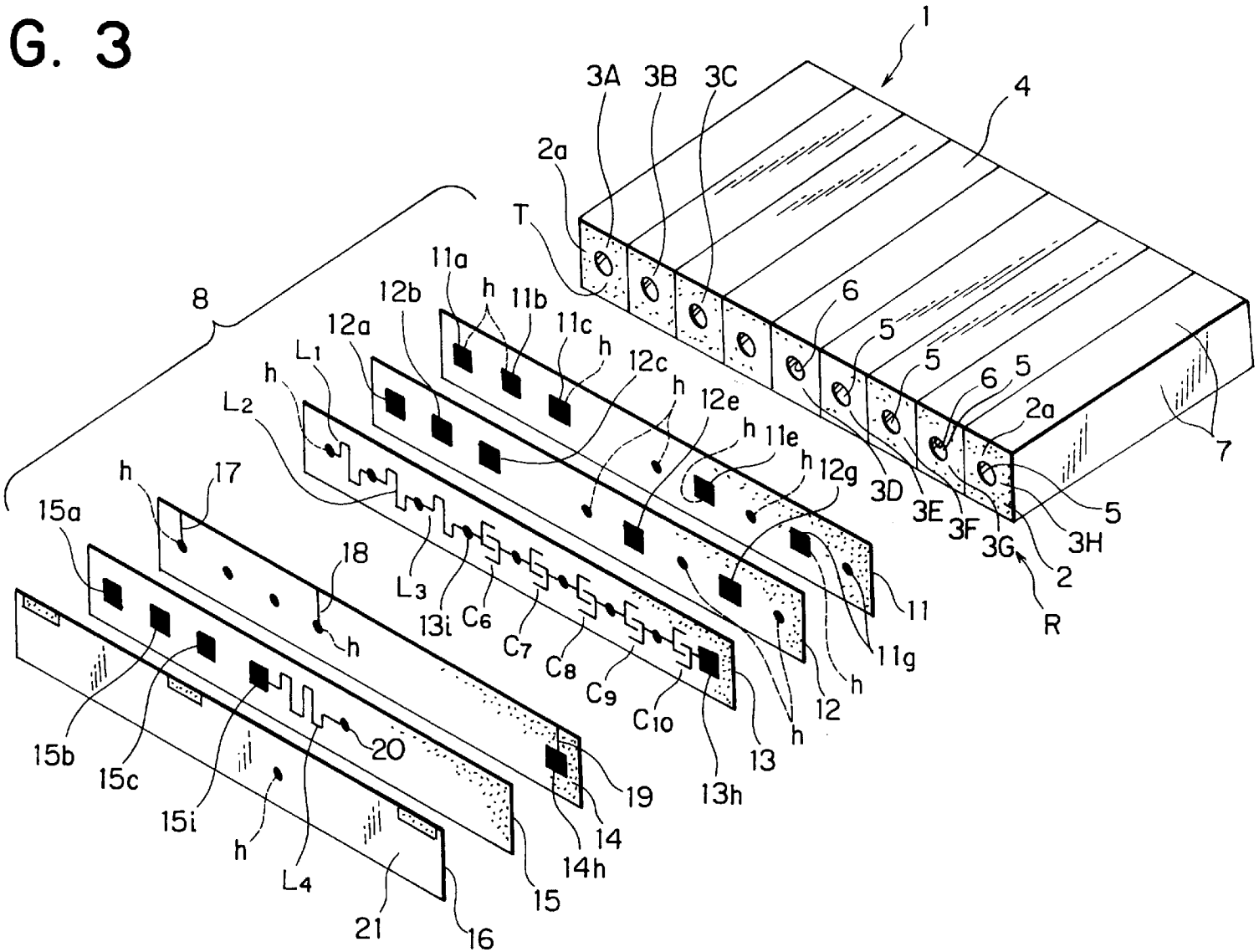
FIG. 3 is another exploded schematic perspective view of the embodiment of FIG. 1, showing only the dielectric duplexer and the circuit laminate separated from each other.

The circuit laminate 8 may be typically made of a glass ceramic material, a composite material containing both glass and dielectric ceramic or a low melting point oxide. As illustrated in FIG. 3, the circuit laminate 8 comprises a plurality of identical rectangularly parallel-epipedic dielectric sheets 11 through 16 each having a contour same as that of the open-circuit end surface of the dielectric duplexer 1 which are stacked sequentially and sintered together. The circuit laminate 8 of a multilayer structure of the dielectric sheets 11 through 16 operates as an LC coupling circuit Y having a low pass filter circuit section F1 and a band pass filter section F2. Since the circuit laminate 8 is realized in the form of a single chip obtained by sintering together the dielectric sheets 11 through 16, the dielectric duplexer unit having a neat rectangularly parallel-epipedic profile can be prepared with ease simply by bonding the chip to the open-circuit end surface of the dielectric duplexer 1.

Thus, the circuit laminate 8 operating as a low pass filter coupling circuit is bonded to the open-circuit end surface of the dielectric duplexer 1.

With the circuit laminate 8 thus prepared the low pass filter coupling circuit is coupled to the resonators 3A through 3C of a resonator circuit X as shown in FIG. 6.

Each of the dielectric sheets 11–16 is provided with a conductor pattern on the surface thereof and cutting through holes therethrough.

Now, a specific mode of preparing a combination of a dielectric duplexer and a laminate of dielectric sheets will be described below.

Figure 3A:
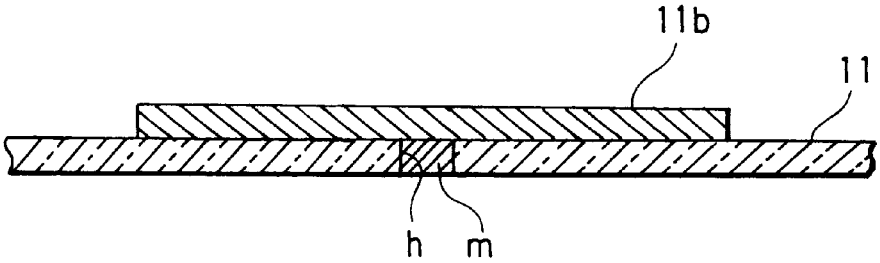
FIG. 3A is an enlarged section showing a part of one dielectric sheet in the circuit laminate of FIG. 3.

On the dielectric sheet 11 three through holes h are provided at positions located vis-a-vis the respective resonators 3A through 3C and filled with respective conducting material m as shown in FIG. 3A, and three electrode layers 11*a*, 11*b* and 11*c* at positions on the front surface thereof located vis-a-vis the respective resonators 3A through 3C. Similarly, a pair of through holes h are provided at positions located vis-a-vis the respective resonators 3E and 3G and filled with respective conducting material, and electrode layers 11*e* and 11*g* are formed at positions on the front surface of the dielectric sheet 11 vis-a-vis the respective resonators 3E and 3G. Then, three through holes h are formed at positions the dielectric sheet 11 located vis-a-vis the respective resonators 3D, 3F and 3H and filled with respective conducting material. Thus, the resonators 3A through 3H are connected to the dielectric sheet 11 by way of the conductors filled in the through holes h.

On the dielectric sheet 12, electrode layers 12*a*, 12*b* and 12*c* are formed on the front surface thereof at positions located vis-a-vis the resonators 3A through 3C respectively, and electrode layers 12*e* and 12*g* are formed at positions located vis-a-vis the respective resonators 3E and 3G, whereas through holes h are formed at positions located vis-a-vis the respective resonators 3D, 3F and 3H. Thus, capacitors C1 through C3 for the low pass filter circuit section F1 are formed between the resonators 3A through 3C, and the electrode layers 12*a*, 12*b* and 12*c* of the dielectric sheet 12, respectively, and capacitors C4 and C5 for the receiver section R are formed between the resonators 3E and 3G and the electrode layers 12*e* and 12*g* of the dielectric sheet, respectively, the capacitances of which capacitors are determined as a function of the thickness of the dielectric sheet 12 and the surface areas of the electrode layers 11*a* through 11*c*, 11*e* and 11*g* and 12*a* through 12*c*, 12*e* and 12*g*, respectively.

The dielectric sheet 13 is provided with through holes h which are filled with respective conducting material being connected to the respective electrode layers 12*a*, 12*b*, 12*c*, 12*e* and 12*g*, and through holes h which are filled with respective conducting material being connected to the resonators 3D, 3F and 3H via the conductors filled in the corresponding holes h of the dielectric sheets 11 and 12. On the front surface of the dielectric sheet 13 a conductive point 13*i* and an electrode layer 13*h* are provided at positions corresponding to the spacer resonator 4 and the resonator 3H, respectively. Winding or zig-zag electroconductive paths are provided on the front surface of the dielectric sheet 13 between the through holes h correlated with the electrode layers 12*a*, 12*b* of the dielectric sheet 12, between the through holes h correlated with the electrode layers 12*b*, 12*c* of the dielectric sheet 12, and between the through hole h correlated with the electrode layer 12*c* of the dielectric sheet 12 and the conductive point 13*i*, respectively, in order to form inductors L1, L2 and L3. Between the conductive point 13*i* and the through hole h correlated with the resonator 3D, between the through holes h correlated with the resonators 3D and 3E, between the through holes h correlated with the resonators 3E and 3F, between the through holes h correlated with the resonators 3F and 3G, and between the through hole h correlated with the resonator 3G and the electrode layer 13*h* five paired electrode layers are interdigitally arranged on the front surface of the dielectric sheet 13 so that they form capacitors C6, C7, C8, C9 and C10, respectively.

The dielectric sheet 14 is provided with four through holes h at positions correlated with the resonators 3A, 3B, 3C and 4. These through holes are filled with respective conducting material. On the front surface of the dielectric sheet 14 an input connecting extension 17 is provided to be extended from the through hole h at position correlated with the resonator 3A to the upper edge of the dielectric sheet 14. This input connecting extension 17 is connected to the electrode layer 12*a* of the dielectric sheet 12 via the conductors filled in the through holes h of the dielectric sheets 13 and 14 at positions correlated with the resonator 3A. Also, an antenna connecting extension 18 is extended from the through hole h at position correlated with the conductive point 13*i* on the dielectric sheet 13 to the upper edge of the dielectric sheet 14. The antenna connecting extension 18 is connected to the conductive point 13*i* on the dielectric sheet 13 or the connection between the inductor L3 and the capacitor C6 on the dielectric sheet 13. Furthermore, an electrode layer 14*h* is provided on the front surface of the dielectric sheet 14 at position correlated with the electrode layer 13*h* on the dielectric sheet 13 or the resonator 3H. This electrode layer 14*h* forms a capacitor C11 together with the electrode layer 13*h* on the dielectric sheet 13. An output connecting extension 19 is extended from the electrode layer 14*h* to the upper edge of the dielectric sheet 14.

The dielectric sheet 15 is provided with four through holes h at positions correlated with the resonators 3A, 3B, 3C, 4, which are filled with respective conducting material. On the front surface of the dielectric sheet 15 there are provided four electrode layers 15*a*, 15*b*, 15*c* and 15*i* at positions correlated with the resonators 3A, 3B, 3C, 4, respectively. The electrode layers 15*a*, 15*b* and 15*c* are connected to the electrode layers 12*a*, 12*b* and 12*c* on the dielectric sheet 12 via the conductors filled in the corresponding holes h of the dielectric sheets 13 and 14, respectively, and the electrode layer 15*i* is connected to the conductive point 13*i* on the dielectric sheet 13 or the connection between the inductor L3 and the capacitor C6 thereon. Furthermore, a winding or zig-zag electroconductive path is extended from the electrode layer 15*i* to a conductive point 20 to form another inductor L4.

The dielectric sheet 16 is provided with a grounding conductor layer 21 on the front surface thereof and a through hole h filled with conducting material which is connected to the conductive connection point 20 connected with one end of the inductor L4 on the dielectric sheet 15. The grounding conductor layer 21 is cooperated with the electrode layers 15*a* through 15*c* and 15*i* by way of the dielectric sheet 16 to form capacitors C12 through C15.

Figure 4:
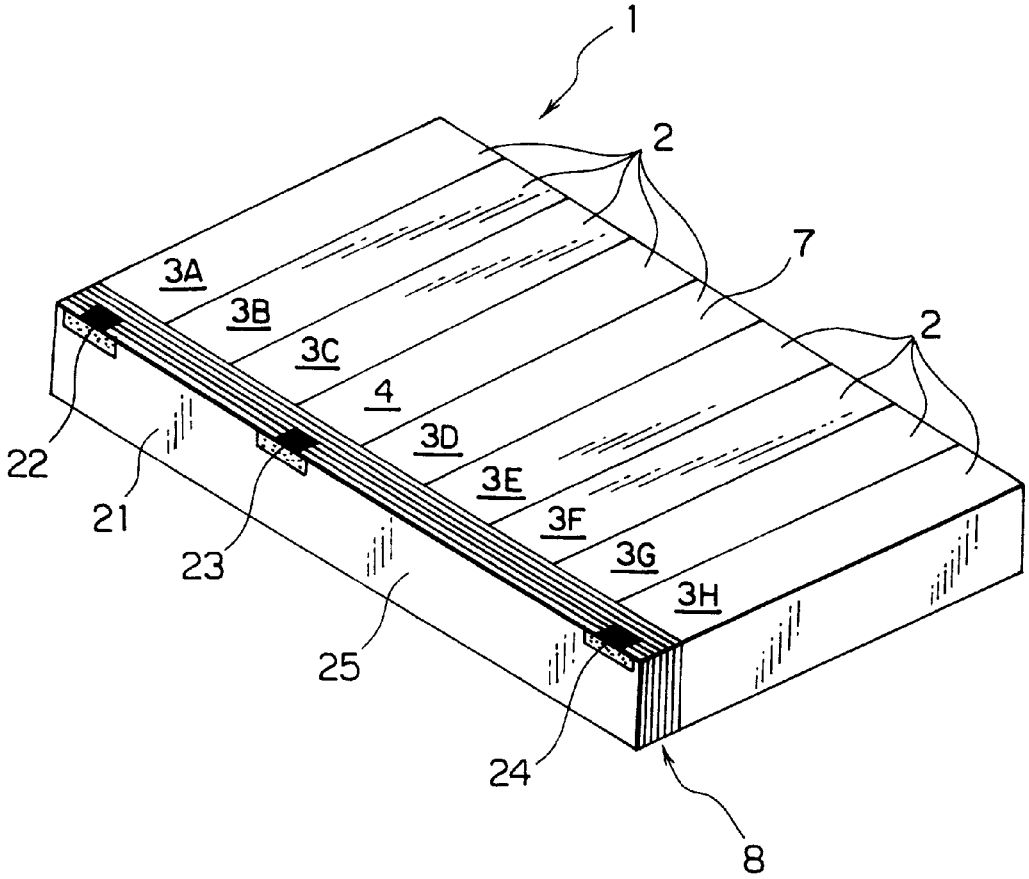
FIG. 4 is a schematic perspective view of the dielectric duplexer and the circuit laminate in the embodiment of FIG. 1 that are bonded to each other.

After the laminate 8 is prepared by stacking the dielectric sheets 11 through 16 to each other, an input terminal pad 22, an antenna terminal pad 23 and an output terminal pad 24 are provided on the upper surface of the laminate 8 as shown in FIG. 4. The input terminal pad 22 is arranged to be connected to the input connecting extension 17 on the dielectric sheet 14, the antenna terminal pad 23 is arranged to be connected to the antenna connecting extension 18 on the dielectric sheet 14, and the output terminal pad 24 is arranged to be connected to the output connecting extension 19 on the dielectric sheet 14. Also, a grounding conductor 25 is provided on the bottom surface of the laminate 8 and is connected to the grounding conductor layer 21 on the dielectric sheet 16 and the grounding conductor 7 on the dielectric duplexer 1 by means of conductors not shown.

Thus, simply by laying the plurality of dielectric sheets 11 through 16 on the open-circuit end surface of the dielectric duplexer 1 or the open-circuit end surfaces 2*a* of all the dielectric ceramic blocks 2, the low pass filter circuit section F1 including the capacitors C1 through C3 and C12 through C14 and the inductors L1 through L3 is coupled to the resonators 3A, 3B and 3C of the transmitter section T and the band pass filter circuit section F2 including the capacitors C4 through C11 is coupled to the resonators 3D through 3H of the receiver section R while the LC coupling circuit Y is formed by coupling the antenna terminal, the capacitor C15 and the inductor L4. There is provided a transmitter/receiver circuit which comprises the LC coupling circuit Y and the resonator circuit X including the resonators 3A through 3C of the transmitter section T and the resonator 3D through 3H of the receiver section R as shown in FIG. 6.

Figure 2:
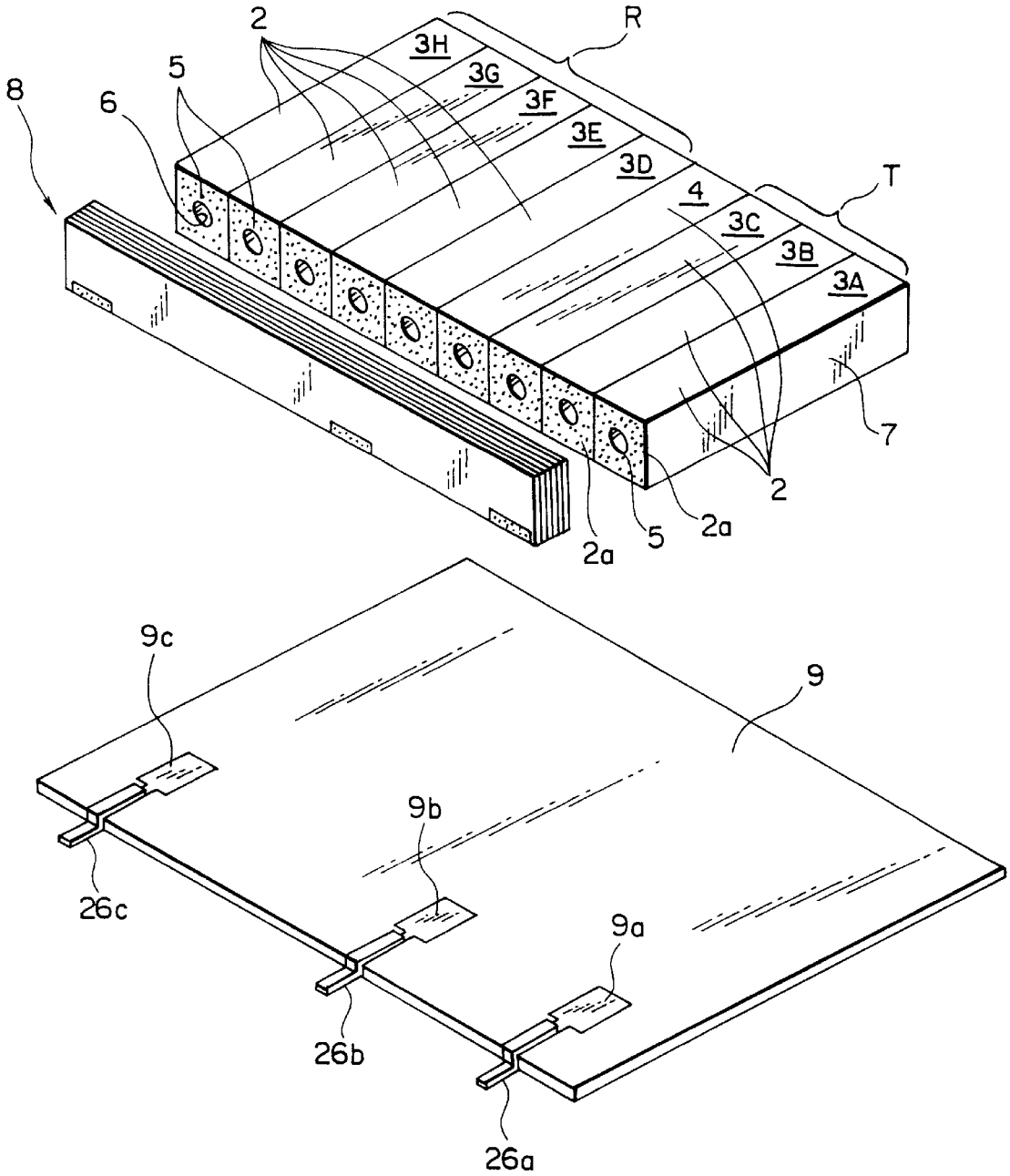
FIG. 2 is another exploded schematic perspective view of the embodiment of FIG. 1, showing only a dielectric duplexer, a circuit laminate and a substrate separated from each other.

The dielectric duplexer 1 to which the circuit laminate 8 is bonded is then mounted on the substrate 9 with the pads 22, 23 and 24 facing downward as shown in FIGS. 1 and 2. The substrate 9 is provided in advance with three conductor pads 9*a*, 9*b* and 9*c*, and an input terminal 26*a*, an antenna terminal 26*b* and an output terminal 26*c* which are connected to the respective conductor pads 9*a*, 9*b* and 9*c* and can be connected to external electric paths. Then, the input terminal pad 22, the antenna terminal pad 23 and the output terminal pad 24 on the laminate 8 are connected to the respective conductor pads 9*a*, 9*b* and 9*c* on the substrate 9, and thus the input terminal 26*a*, the antenna terminal 26*b* and the output terminal 26*c* on the substrate 9 are connected to the filter circuit comprising the dielectric duplexer 1 and the circuit laminate 8.

After mounting the dielectric duplexer 1 to which the circuit laminate 8 is bonded on the substrate 9, the metal casing 10 is put on the dielectric duplexer 1 and the circuit laminate 8 to cover them. Then, the input terminal 26*a*, the antenna terminal 26*b* and the output terminal 26*c* are exposed to the outside to allow them connected to the external electric paths. Thus, the dielectric duplexer assembly is unitized and can be used easily for mobile telecommunications equipment.

Figure 7:
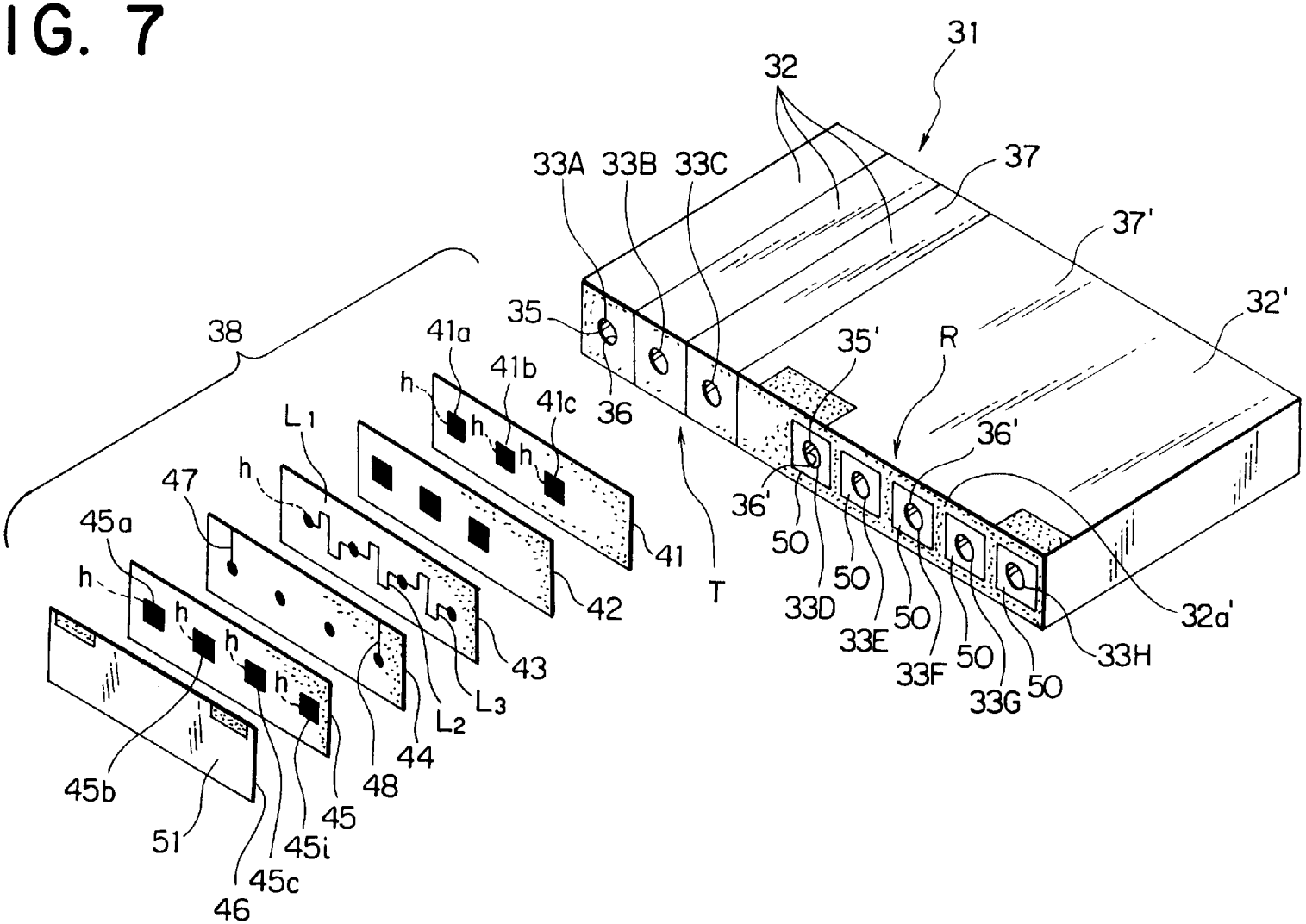
FIG. 7 is an exploded schematic perspective view of another embodiment of dielectric duplexer unit according to the invention and showing only the dielectric duplexer and the circuit laminate separated from each other.
Figure 8:
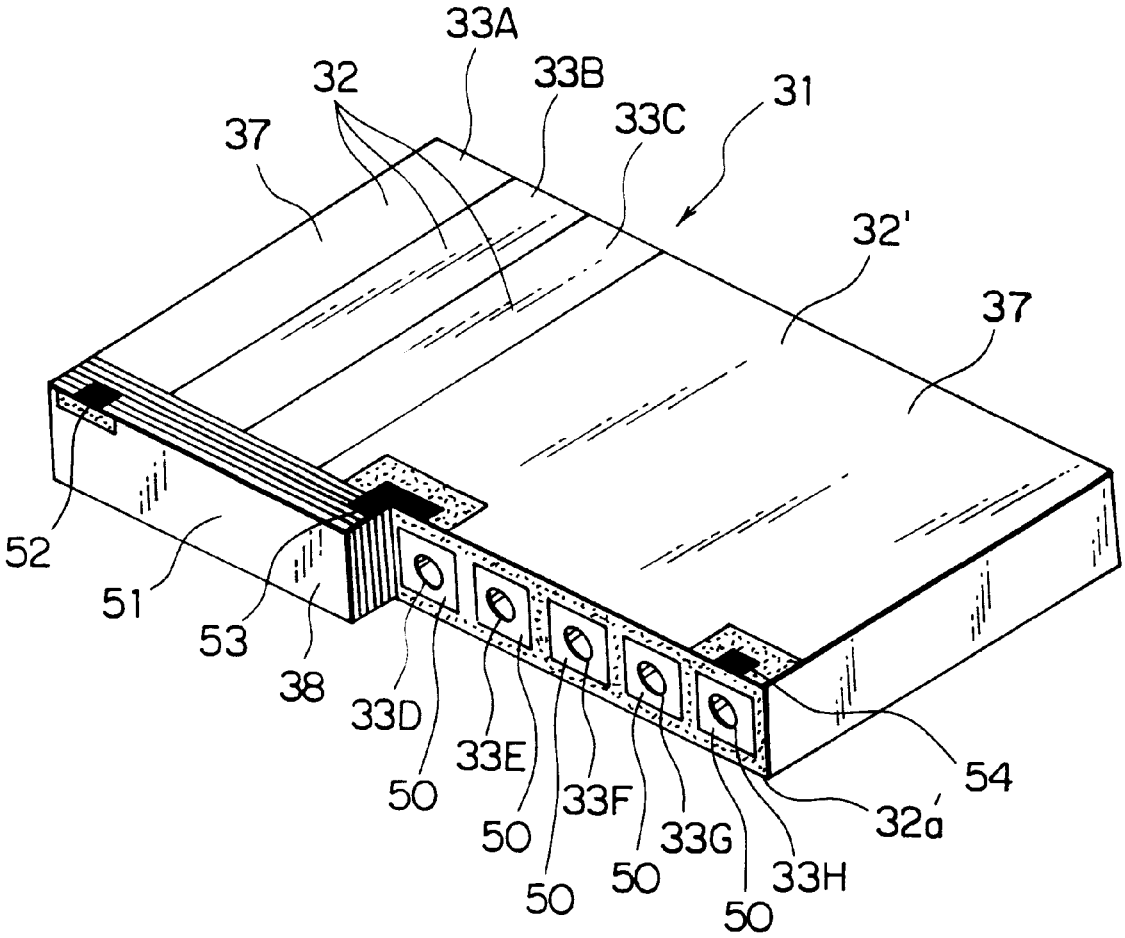
FIG. 8 is an schematic perspective view of the dielectric duplexer and the circuit laminate of the embodiment of FIG. 7 that are bonded to each other.

FIGS. 7 and 8 schematically illustrate a second preferred embodiment of the invention. The illustrated dielectric duplexer 31 comprises a transmitter section T including three resonators 33A, 33B and 33C and a receiver section R including five resonators 33D, 33E, 33F, 33G and 33H. Each of the resonators 33A, 33B and 33C in the transmitter section T comprises a through hole 35 provided through a respective dielectric ceramic block 32 and an inner conductor layer 36 formed on the inner peripheral surface of the through hole 35 as in the first embodiment. These resonators 33A, 33B and 33C are arranged side by side and bonded together. The resonators 33D, 33E, 33F, 33G and 33H in the receiver section R are provided side by side in a single dielectric block 32'. Each of the resonators 33D, 33E, 33F, 33G and 33H comprises respective through hole 35' provided through the single dielectric block 32' and an inner conductor layer 36' formed on the inner peripheral surface of the through hole 35'. The outer surfaces of the respective dielectric ceramic blocks 32 and 32' are coated with a grounding conductor layer 37 and 37', respectively except the open-circuit end surface 32*a* and 32*a*' thereof where one of the openings of the through hole is exposed.

Circuit laminate 38 is coupled with the open-circuit end surface 32*a* of the transmitter section T in the dielectric duplexer 31. The circuit laminate 38 may be typically made of a glass ceramic material, a composite material containing both glass and dielectric ceramic or a low melting point oxide. As illustrated in FIG. 7, the circuit laminate 38 comprises a plurality of identical rectangularly parallelepipedic dielectric sheets 41 through 46 each having a contour same as that of the open-circuit end surface 32*a* of transmitter section T in the dielectric duplexer 31 which are stacked sequentially and sintered together. Therefore, the circuit laminate 38 is realized in the form of a single chip. The circuit laminate 38 of a multilayer structure of the dielectric sheets 41 through 46 operates as an LC coupling circuit Y having a low pass filter circuit section F1. The dielectric duplexer unit 31 can be prepared with ease simply by bonding the chip to the open-circuit end surface 32*a* of the dielectric duplexer 31.

It will be noted that the equivalent circuit of FIG. 6 is also applicable to the dielectric duplexer 31 of this embodiment.

On the dielectric sheet 41 three through holes h are provided at positions located vis-a-vis, i.e., in registration with, the respective resonators 33A through 33C and filled with respective conducting material in the same manner as that of FIG. 3A, and three electrode layers 41*a*, 41*b* and 41*c* at positions on the front surface thereof located vis-a-vis the respective resonators 33A through 33C. Thus, the resonators 33A through 33C are connected to the electrode layers 41*a*, 41*b* and 41*c* by way of the conductors filled in the through holes h.

On the dielectric sheet 42, electrode layers 42*a*, 42*b* and 42*c* are formed on the front surface thereof at positions located vis-a-vis the resonators 33A through 33C respectively. Thus, capacitors C1 through C3 for the low pass filter circuit section F1 are formed between the resonators 33A through 33C, and the electrode layers 42*a*, 42*b*, and 42*c* of the dielectric sheet 42, respectively, the capacitances of which capacitors are determined as a function of the thickness of the dielectric sheet 42 and the surface areas of the electrode layers 41*a* through 41*c*, respectively.

The dielectric sheet 43 is provided with through holes h which are filled with respective conducting material being connected to the respective electrode layers 42*a*, 42*b* and 42*c*. On the front surface of the dielectric sheet 43 a conductive point 43*i* is provided. Winding or zig-zag electro-conductive paths are provided on the front surface of the dielectric sheet 43 between the through holes h correlated with the electrode layers 42*a* and 42*b* of the dielectric sheet 42, between the through holes h correlated with the electrode layers 42*b* and 42*c* of the dielectric sheet 42, and between the through hole h correlated with the electrode layer 42*c* of the dielectric sheet 42 and the conductive point 43*i*, respectively, in order to form inductors L1, L2 and L3.

The dielectric sheet 44 is provided with four through holes h at positions correlated with the resonators 33A, 33B, 33C and a spacer between the transmitter section T and the receiver section R. These through holes are filled with respective conducting material. On the front surface of the dielectric sheet 44 an input connecting extension 47 is provided to be extended from the through hole h at position correlated with the resonator 33A to the upper edge of the dielectric sheet 44. This input connecting extension 47 is connected to the electrode layer 42*a* of the dielectric sheet 42 via the conductors filled in the through holes h of the dielectric sheets 43 and 44 at positions correlated with the resonator 33A. Also, an antenna connecting extension 48 is extended from the through hole h at position correlated with the conductive point 43*i* on the dielectric sheet 43 to the upper edge of the dielectric sheet 44. The antenna connecting extension 48 is connected to the conductive point 43*i* on the dielectric sheet 43.

The dielectric sheet 45 is provided with four through holes h at positions correlated with resonators 33A, 33B, 33C and a spacer, which are filled with respective conducting material. On the front surface of the dielectric sheet 45 there are provided four electrode layers 45*a*, 45*b*, 45*c* and 45*i* at positions correlated with the resonators 33A, 33B, 33C and the spacer, respectively. The electrode layers 45*a*, 45*b* and 45*c* are connected to the electrode layers 42*a*, 42*b* and 42*c* on the dielectric sheet 42 via the conductors filled in the corresponding holes h of the dielectric sheets 43 and 44, respectively, and the electrode layer 45*i* is connected to the conductive point 43*i* on the dielectric sheet 43.

The dielectric sheet 46 is provided with a grounding conductor layer 51 on the front surface thereof which is cooperated with the electrode layers 45*a* through 45*c* and 45*i* by way of the dielectric sheet 46 to form capacitors.

After the laminate 38 is prepared by stacking the dielectric sheets 41 through 46 to each other, an input terminal pad 52 and an antenna terminal pad 53 are provided on the upper surface of the laminate 38 as shown in FIG. 8.

The input terminal pad 52 is arranged to be connected to the input connecting extension 47 on the dielectric sheet 44, the antenna terminal pad 53 is arranged to be connected to the antenna connecting extension 48 on the dielectric sheet 44 and is extended to the upper surface of the dielectric block 32*a*' at a position vis-a-vis the resonator 33D to form a capacitor C6 but is insulated from the grounding conductor layer 37' on the upper surface of the dielectric block 32*a*'. Also, a grounding conductor 55 is provided on the bottom surface of the laminate 38 and is connected to the grounding conductor layer 51 on the dielectric sheet 46 and the grounding conductor 37 on the transmitter section T in the dielectric duplexer 31.

Therefore, the single chip circuit laminate 38 forms a low pass filter circuit section F1 of this embodiment because the inductors L1 through L3 can be formed from the circuit laminate without difficulty.

On the open-circuit end surface of the single dielectric block 32' there are provided electro-conductive layers 50 which surround the open-circuit ends of the respective resonators 33D, 33E, 33F, 33G and 33H and are electrically connected to the inner conductors of the resonators. Thus, coupling capacitors are formed by the adjacent electro-conductive layers 50.

These electro-conductive layers 50 may be formed as follows. Spot facings are formed on the respective openings of the respective resonators 33D, 33E, 33F, 33G and 33H at the open side of the dielectric block 32' and the surfaces of the spot facings are coated with a conductor or, alternatively, patterned conductors are formed at the open-circuit end surface of the dielectric block 32' to provide the electro-conductive layers 50 which are by turn capacitively coupled with each other to form capacitors C7 through C10.

An output terminal pad 54 is provided on the upper surface of the dielectric block 32' at a position vis-a-vis the resonator 33H to form a capacitor C11.

It will be appreciated that, while the circuit laminate 38 is used to form the low pass filter circuit section F1 that comprises the inductors L1 through L3 because the inductors can be formed without difficulty by arranging patterned conductors on the surfaces of the dielectric sheets, a band pass filter circuit section F2 comprising capacitors can be prepared in a conventional manner.

The dielectric duplexer 31 thus provided is then mounted on a substrate with the pads facing downward as in the case of FIGS. 1 and 2.

While the dielectric duplexer comprises a plurality of coaxial type resonators in each of the above described embodiments, it may alternatively be provided by forming a plurality of through holes through a single dielectric block and coating the inner peripheral surfaces of the through holes with an inner conductor to produce a plurality of resonators arranged side by side in the single dielectric block.

As described above in detail, according to the invention, the circuit laminate 8 or 38 formed by laying a plurality of dielectric sheets 11–16 or 41–46 is arranged on the open-circuit end surface of the dielectric duplexer 1 or 31 and the LC coupling circuit Y is coupled to the resonators of the transmitter section T and/or the resonators of the receiver section R to produce a transmitter/receiver circuit and they are housed in the metal casing to produce a dielectric duplexer unit. Alternatively, the LC coupling circuit Y may be coupled to the resonators of the receiver section R.

Thus, the present invention provides the following advantages.

1) The unit has a neat and simple profile and the filter circuit is down sized to allow the use of a small dielectric substrate so that the entire unit is also down sized.

2) A filter circuit is formed only by a dielectric duplexer and dielectric sheets so that a simple wiring arrangement can be used on the substrate and the entire unit can be manufactured in a simple manner.

3) Because a filter circuit is formed only by a dielectric duplexer and dielectric sheets, the unit can have an increased mechanical strength and an improved impact resistance.

4) Since the LC coupling circuit Y is enclosed in the circuit laminate, it is isolated from the external atmosphere and made free from the influences of external factors including the humidity of the atmosphere and mechanical impacts to ensure an improved performance.

5) Since the LC coupling circuit is formed in the circuit laminate, desired circuit constants can be selected to provide an enhanced level of freedom for the design of the dielectric duplexer.

6) When the circuit laminate is realized in the form of a single chip by laying a plurality of dielectric layers and sintering them, it can be assembled with the dielectric duplexer simply by bonding the circuit laminate to the open-circuit end surface of the dielectric duplexer to facilitate the manufacture of such units at high yield.

What is claimed is:

1. A dielectric duplexer unit with a coupling circuit, said unit comprising:

a dielectric duplexer which includes a plurality of resonators arranged in parallel along a same direction, said resonators being divided into a transmitter section and a receiver section;

a substrate for carrying said dielectric duplexer thereon; and

LC coupling circuit means for providing coupling to predetermined ones of the resonators of the dielectric duplexer, said LC coupling circuit means comprising a circuit laminate of a plurality of dielectric sheets arranged in direct contact with an open-circuit end surface of only said transmitter section and connected only to the resonators in the transmitter section to form a transmission circuit for the dielectric duplexer.

2. A dielectric duplexer unit as claimed in claim 1, wherein said circuit laminate includes a low pass filter circuit section which comprises a plurality of dielectric sheets arranged on a transmitter region of the open-circuit end surface of said dielectric duplexer, said sheets being sintered to form the circuit laminate and said low pass filter being connected to the resonators of the transmitter section, said unit further comprising a plurality of conductive layers arranged on a receiver region of the open-circuit end surface of the dielectric duplexer and connected to inner conductors of the resonators of the receiver section, said conductive layers being capacitively coupled with respect to each other to form a band pass filter circuit section.

3. A dielectric duplexer unit as claimed in claim 2, wherein said circuit laminate includes an input terminal pad and an antenna terminal pad which are formed on a surface thereof coming into contact with said substrate.

4. A dielectric duplexer unit as claimed in claim 3, wherein said antenna terminal pad is extended to a surface of the dielectric duplexer to be mounted on said substrate and positioned to be correlated to a predetermined one of the resonators in the receiver section.

5. A dielectric duplexer unit as claimed in claim 1, wherein an output terminal pad is provided to be correlated to a predetermined one of the resonators in the receiver section.

6. A dielectric duplexer unit as claimed in claim 1, wherein the transmitter section of said dielectric duplexer comprises a plurality of dielectric blocks, each of said block including a coaxial resonator which has a through hole bored through the respective dielectric block and an inner conductor layer provided on an inner peripheral surface of the through hole.

7. A dielectric duplexer unit as claimed in claim 1, wherein the receiver section of said dielectric duplexer is formed on a single dielectric block including a plurality of coaxial resonators arranged in parallel with respect to each other, each of said resonators having a through hole and an inner conductor layer provided on an inner peripheral surface of the through hole.

8. A dielectric duplexer unit with a coupling circuit, said unit comprising:

a dielectric duplexer which includes a plurality of resonators arranged in parallel along a same direction, said resonators being divided into a transmitter section and a receiver section;

a substrate for carrying said dielectric duplexer thereon; and

LC coupling circuit means for providing coupling to predetermined ones of the resonators of the dielectric duplexer, said LC coupling circuit means comprising a circuit laminate of a plurality of dielectric sheets arranged in direct contact with an open-circuit end surface of only said receiver section and connected only to the resonators in the receiver section to form a reception circuit for the dielectric duplexer.

* * * * *